US007695032B2

(12) United States Patent
Bodily

(10) Patent No.: US 7,695,032 B2
(45) Date of Patent: Apr. 13, 2010

(54) 360 DEGREE ADJUSTABLE DEADBOLT ASSEMBLY

(75) Inventor: Jerry B. Bodily, Colorado Springs, CO (US)

(73) Assignee: Schlage Lock Company, Carmel, IN (US)

( * ) Notice: Subject to any disclaimer, the term of this patent is extended or adjusted under 35 U.S.C. 154(b) by 451 days.

(21) Appl. No.: 11/368,069

(22) Filed: Mar. 3, 2006

(65) Prior Publication Data

US 2006/0208509 A1 Sep. 21, 2006

Related U.S. Application Data

(60) Provisional application No. 60/658,524, filed on Mar. 4, 2005.

(51) Int. Cl.
*E05B 9/00* (2006.01)

(52) U.S. Cl. ..... 292/337; 292/1.5; 292/DIG. 60

(58) Field of Classification Search ..... 292/337, 292/1.5 X, DIG. 60 X, DIG. 53
See application file for complete search history.

(56) References Cited

U.S. PATENT DOCUMENTS

| | | | | |
|---|---|---|---|---|
| 244,405 | A | 7/1881 | Strong | |
| 261,998 | A | 8/1882 | Carson | |
| 273,327 | A | 3/1883 | Waterhouse | |
| 291,672 | A | 1/1884 | Bourke | |
| 316,282 | A * | 4/1885 | McKormick | 292/140 |
| 1,672,076 | A | 6/1928 | Munson | |
| 1,907,625 | A | 5/1933 | Vogt | |
| 2,088,665 | A | 8/1937 | Pinson | |
| 2,983,540 | A | 5/1961 | Check | |
| 3,315,998 | A * | 4/1967 | Dallaire | 292/61 |
| 4,372,594 | A | 2/1983 | Gater | |
| 4,539,025 | A | 9/1985 | Ciliberti et al. | |
| 4,583,775 | A * | 4/1986 | Bisbing | 292/64 |
| 4,664,433 | A * | 5/1987 | Solovieff | 292/337 |
| 4,671,547 | A | 6/1987 | Weinerman et al. | |
| 4,679,835 | A | 7/1987 | Weinerman et al. | |
| 4,725,086 | A | 2/1988 | Shen | |
| 4,752,090 | A * | 6/1988 | Lin | 292/1.5 |
| 4,759,576 | A | 7/1988 | Ching | |
| 4,834,432 | A | 5/1989 | Smallegan et al. | |
| 4,840,412 | A | 6/1989 | Shen | |
| 4,950,008 | A | 8/1990 | Fang | |
| 4,979,768 | A | 12/1990 | Marotto et al. | |
| 5,094,488 | A | 3/1992 | Boadwine et al. | |
| 5,152,558 | A | 10/1992 | Smith et al. | |
| 5,176,416 | A | 1/1993 | Lin | |

(Continued)

*Primary Examiner*—Peter M. Cuomo
*Assistant Examiner*—Mark Williams
(74) *Attorney, Agent, or Firm*—Michael Best & Friedrich LLP

(57) ABSTRACT

An adjustable backset deadbolt assembly providing operational and structural improvements. The deadbolt assembly can provide adjustability between a first backset dimension and a second backset dimension for allowing installation in doors conforming to various industry standards. The deadbolt assembly can provide adjustability between backset dimensions by relative rotation between the inner bolt housing and the outer housing. The inner bolt housing may be provided with a depressible snap finger to allow insertion of a protrusion thereon into a slot in the outer housing. In some embodiments, the slot is provided substantially helically through an angle of 360 degrees to provide common orientation of parts in each backset dimension. The outer housing may be provided to integrally form a cam housing and a bolt housing.

22 Claims, 15 Drawing Sheets

U.S. PATENT DOCUMENTS 5,253,904 A 10/1993 Ruby
5,364,138 A 11/1994 Dietrich et al.
5,456,503 A 10/1995 Russell, IV
5,458,382 A 10/1995 Boadwine et al.
5,489,128 A * 2/1996 Florian ..... 292/1.5
5,498,037 A 3/1996 Fan Lai
5,501,492 A 3/1996 Kajuch
5,516,160 A 5/1996 Kajuch
5,562,314 A * 10/1996 Wheatland et al. ..... 292/1.5
5,613,715 A 3/1997 Kim
5,738,389 A 4/1998 Marks
5,765,412 A 6/1998 Koskala et al.
5,944,366 A 8/1999 Aramburu
5,957,510 A 9/1999 Kuo
6,536,812 B1 3/2003 Winardi
6,554,330 B2 4/2003 Wen-Bin et al.
6,640,592 B2 11/2003 Vickers
6,764,112 B2 7/2004 Lan-Shi et al.
6,837,526 B2 1/2005 Markbreit
6,843,082 B2 1/2005 Vickers
6,880,871 B2 * 4/2005 Winardi ..... 292/337
2004/0130162 A1 7/2004 Don et al.
2007/0052245 A1 3/2007 Bodily
2007/0052250 A1 3/2007 Bodily

* cited by examiner

SECTION C-C

SECTION A-A

SECTION C'-C'

SECTION A'-A'

SECTION B-B

SECTION B'-B'

SECTION D-D

SECTION D'-D'

SECTION G-G

SECTION E-E

SECTION G'-G'

SECTION E'-E'

SECTION F-F

SECTION F'-F'

SECTION H-H

SECTION H'-H'

360 DEGREE ADJUSTABLE DEADBOLT ASSEMBLY

REFERENCE TO RELATED APPLICATIONS

This application claims the benefit of U.S. Provisional Patent Application Ser. No. 60/658,524 filed on Mar. 4, 2005, the entire contents of which is incorporated by reference.

BACKGROUND

The present invention relates to locking mechanisms, and more particularly to deadbolt assemblies adjustable for different backset dimensions.

Deadbolts have long been known to prevent unwanted access through doors and the like. Typically, a deadbolt is installed in a door with a bolt, which is extendable from the edge of the door and engages an adjacent wall when extended. An actuator is generally provided on one side of the door to allow an operator to move the bolt between extended and retracted positions. The actuator is generally rotatable about an axis perpendicular to the door and is spaced from the edge by a distance commonly referred to as the backset. Backset dimension can vary among applications, but two industry standard values are 2⅜ inches and 2¾ inches. Rather than develop and produce separate deadbolt assemblies for the different backset dimensions, it is advantageous not only for the manufacturer, but also the consumer, to provide a deadbolt assembly, which is adjustable and therefore capable of being used with either a 2⅜ inch backset or a 2¾ backset.

SUMMARY

In one embodiment, the invention provides an adjustable backset deadbolt assembly including a bolt configured for axial movement between a retracted position and an extended position. An outer bolt housing has a helical slot of about 360 degrees. An inner bolt housing is positioned on an interior side of the outer bolt housing and has a protrusion engageable in the helical slot of the outer bolt housing. A bolt bar is positioned to transfer rotational input movement to the axial movement of the bolt. A backset dimension is adjustable between a first value and a second value.

In another embodiment the invention provides an adjustable backset deadbolt assembly including a bolt movable along an axis between an extended position and a retracted position. A cam is operable to actuate the bolt between the extended position and the retracted position and vice versa. A housing is rotatable relative to the bolt about the axis. A backset dimension is adjustable between a first predetermined value and a second predetermined value upon relative rotation of about 360 degrees of the housing and the bolt.

In another embodiment the invention provides an adjustable backset deadbolt assembly with a backset dimension adjustable between a first value and a second value. The assembly includes a bolt configured for movement along an axis between a retracted position and an extended position. The bolt has a slot positioned parallel to the axis. An outer bolt housing has a helical slot of about 360 degrees. The helical slot has two ends spaced apart a distance about equal to the difference between the first value and the second value. An inner bolt housing is positioned on an interior side of the outer bolt housing. The inner bolt housing includes a protrusion on an outer face that is engageable in the helical slot of the outer bolt housing. A rib on an inner face of the inner bolt housing provides engagement with the slot in the bolt. An inwardly projecting dimple on the inner bolt housing is positioned to limit movement of the bolt. A bolt bar couples the bolt to an input cam. The bolt is rotatable relative to the bolt bar by movement of a pin fixed to the bolt within a helical slot in the bolt bar to adjust the backset dimension. A detent feature on the outer bolt housing provides feedback confirming positive positioning of the assembly into one of the first and second backset dimension values.

Other aspects of the invention will become apparent by consideration of the detailed description and accompanying drawings.

DETAILED DESCRIPTION

Figure 1:
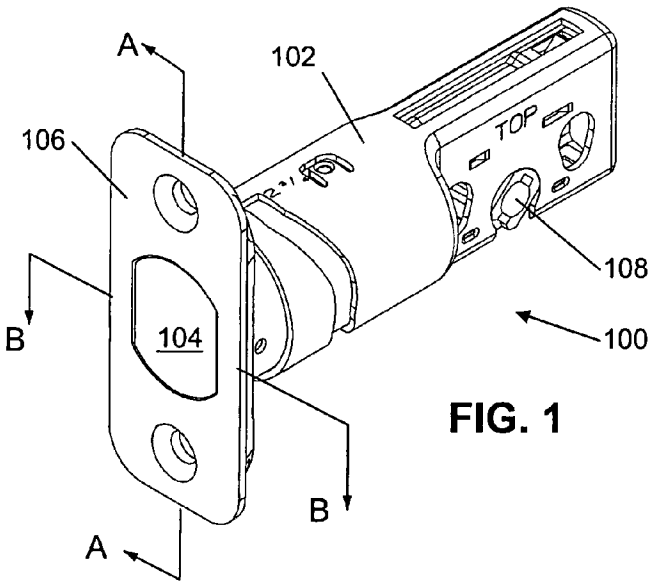
FIG. 1 is a perspective view of a deadbolt assembly with a first backset dimension and the bolt retracted according to a first embodiment.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

A lockset adaptable for different backset dimensions is disclosed by Schlage Lock Company in U.S. Pat. No. 5,152,558, which is hereby incorporated in its entirety by reference. The invention described in detail herein is intended to provide additional benefits to an adjustable deadbolt assembly.

FIGS. 1-14 illustrate views of a deadbolt assembly 100 according to one embodiment of the invention. The deadbolt assembly 100 includes a housing 102, a bolt 104, and a faceplate 106. The housing 102 receives a cam 108, for operation of the bolt 104 along a bolt axis 109 (i.e., central axis) as described in greater detail below. The housing 102 is configured to be positioned within a door (not shown). The faceplate 106 can be installed on an edge of the door between two opposite faces of the door. The faceplate includes an aperture 110 configured to allow passage of the bolt 104 therethrough.

Figure 5:
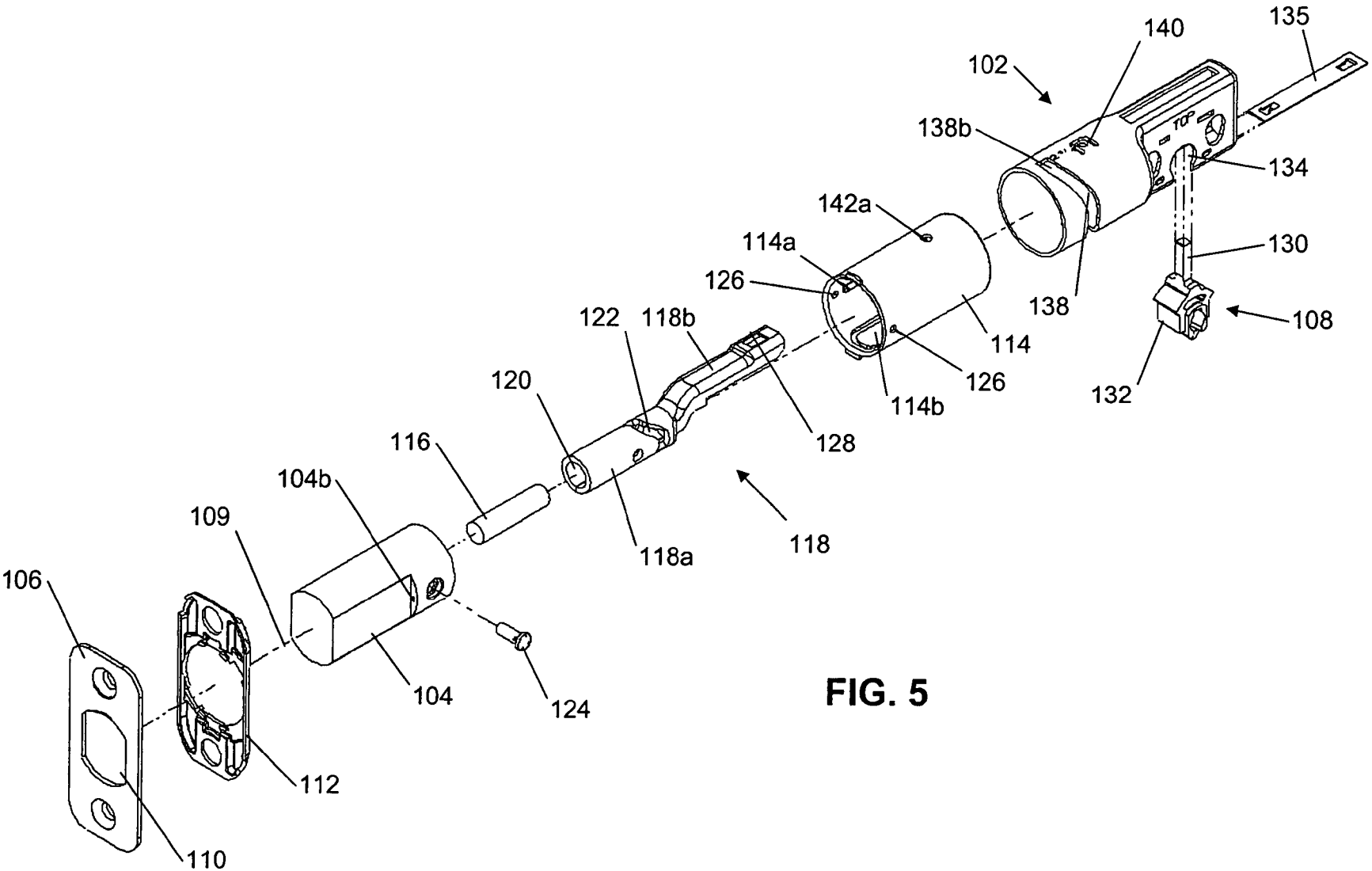
FIG. 5 is an exploded assembly view of the assembly according to the first embodiment.
Figure 6:
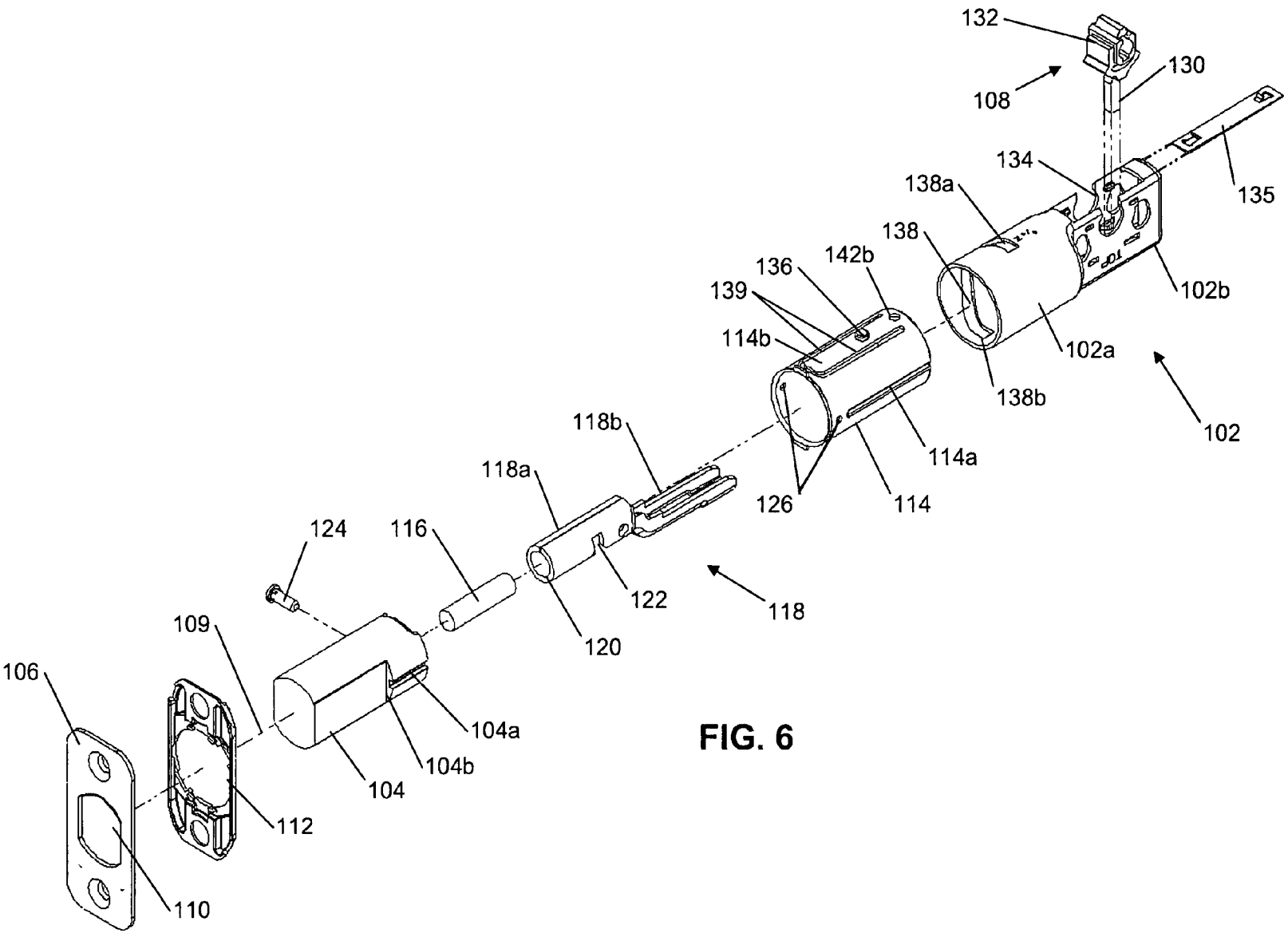
FIG. 6 is a reverse exploded assembly view of the assembly according to the first embodiment.

FIG. 5 illustrates an exploded assembly view showing all the components of the deadbolt assembly 100. FIG. 6 illustrates an exploded assembly view looking from an opposite angle. The end at which the faceplate 106 resides is referred to herein as the "front" wherein the "back" or "rear" relates to the end of the assembly 100 opposite the faceplate 106. The faceplate 106 can be provided with a backing plate 112, which mates with the faceplate 106. In some embodiments, the backing plate 112 is eliminated and such features as are present in the backing plate 112 can be incorporated into the faceplate 106 or eliminated altogether. The bolt 104 fits within an inner bolt housing 114, which is positioned adjacent the faceplate 106. The bolt 104 includes at least one slot 104*a*, which engagingly receives a rib 114*a* positioned on an inner diameter portion of the inner bolt housing 114. The engagement of the rib 114*a* and the slot 104*a* inhibit the inner bolt housing 114 and the bolt 104 from rotating about the axis 109 relative to each other. Both the rib 114*a* and the slot 104*a* are illustrated being formed parallel to the bolt axis 109, but other arrangements may be used for engaging the bolt 104 and the inner bolt housing 114.

With continued reference to FIGS. 5 and 6, an anti-saw rod 116 is positioned at the back side of the bolt 104 to provide security through resistance to sawing, such as by a reciprocating saw or the like. The anti-saw rod 116 can resist being cut by spinning in place when engaged by a blade and/or by being constructed of a hardened steel or another material resistant to sawing. The bolt bar 118 extends from the bolt 104 back into the housing 102 where it is coupled to the cam 108. The bolt bar 118 is provided with a front portion 118*a* and a rear portion 118*b*. The front portion 118*a* is generally cylindrical with an aperture 120 to receive the anti-saw rod 116. Also provided in the front portion 118*a* is a slot 122, which receives a portion of a bolt connector 124. The bolt connector 124 is fixed to the bolt 104 and is slidably received in the slot 122 to adjust the backset as described in greater detail below. The bolt connector 124 can be a fastener, a pin, an integral protrusion, etc., which provides a coupling between the bolt 104 and the bolt bar 118 such that the bolt 104 is movable along the axis 109 with the bolt bar 118 as the bolt bar 118 is actuated. The bolt 104 is thereby movable between an extended position and a retracted position as discussed in greater detail below. At the extended position, the bolt 104 can be inhibited from further extension by the stops 104*b*, which abut dimples 126 formed in the inner bolt housing 114. In an alternate embodiment, the assembly 100 may not require the dimples 126, and instead relies on any of the faceplate 106, the backing plate 112, and the interface between the actuator 130 of the cam 108 and the engaging portion 128 of the bolt bar 118 to limit the extension of the bolt 104.

The rear portion 118*b* of the bolt bar 118 is provided with an engaging portion 128, which is engageable with an actuator 130 of the cam 108. The engaging portion 128 is illustrated as a rectangular aperture through the rear portion 118*b*, which receives the cam actuator 130. However, the rear portion 118*b* can be provided with any one of a various assortment of cam following structures to enable the bolt bar 118 (and thus, the bolt 104) to be cammed between extended and retracted positions. The cam 108 includes a cam body 132, which is held in a recess 134 of the housing 102. The cam 108 is rotatable about a fixed axis defined by the recess 134 to enable camming of the bolt bar 118 to actuate the bolt 104 to move from the retracted position to the extended position or vice versa. FIGS. 2, 4, 8, 10, 13 and 14 illustrate the bolt 104 in the extended position, and FIGS. 1, 3, 7, 9, 11, and 12 illustrate the bolt 104 in the retracted position. A spring plate 135 is positioned at a rear portion 102*b* of the housing 102 to provide an upward bias to the cam 108. The spring plate 135 can assist in positively placing the cam 108 in either one of its limit positions, which correspond to the extended and retracted positions of the bolt 104.

Returning to FIGS. 5 and 6, the inner bolt housing 114 is generally cylindrical and is positioned within a front portion 102*a* of the housing 102 during operation. The inner bolt housing 114 is provided with a protrusion 136 on an outer wall thereof for engaging a slot 138 in the housing 102. The protrusion 136 is located on a depressible portion such as a depressible snap finger 114*b*, which can be defined by an elongated "U-shape" groove 139 cut into the inner bolt housing 114. The depressible snap finger 114*b* is elastically deformable such that it is movable relative to the remainder of the inner bolt housing 114 under sufficient load. The spring behavior of the depressible snap finger 114*b* allows the inner bolt housing 114 to be inserted into the housing 102 during assembly. The depressible snap finger 114*b* can be deflected (the protrusion 136 being deflected with it), allowing the inner bolt housing 114 to be inserted into the housing 102 until the protrusion 136 is aligned with any part of the slot 138 in the housing 102. Once inserted, the depressible snap finger 114*b* can substantially spring back to its original shape and position, positioning the protrusion 136 in the slot 138. The inner bolt housing 114 is thereby rotatably engaged with the housing 102 in order to allow the adjustment for different backset dimensions as described in greater detail below. In some embodiments, once assembled in the inner bolt housing 114, the bolt 104 blocks the depressible snap finger 114*b* from significant inward deflection to prevent inadvertent separation. The bolt 104 remains in contact with or directly inward of the depressible snap finger 114*b* in the retracted position, the extended position, and throughout adjustment between the two positions. This inhibits the protrusion 136 from escaping the slot 138.

In some embodiments, the housing 102 and the inner bolt housing 114 are reversed such that the inner bolt housing 114 encompasses the housing 102 within it. In some embodiments, the protrusion 136 and the slot 138 are reversed such that the protrusion 136 is located on the housing 102 and the slot 138 is located in the inner bolt housing 114. In some embodiments, both the inner/outer orientation and the protrusion 136 and slot 138 are reversed. In such embodiments, a depressible portion may be provided on the housing 102 to allow deflection of the protrusion 136 radially inwardly. The depressible portion allows the housing 102 to be inserted into the inner bolt housing 114 such that the protrusion 136 engages the slot 138. Further adaptations obvious to those skilled in the art can allow the assembly 100 to function in accordance with objectives of the invention as described throughout.

With continued reference to the figures, the protrusion 136 is engaged with the slot 138 when the inner bolt housing 114 is assembled within the housing 102. The slot 138 is generally helically disposed in the housing 102 such that the slot includes a first end 138*a* and a second end 138*b*, which are spaced a distance apart along an axis parallel to the bolt axis 109. The distance is generally equivalent to the difference between two predetermined backset dimensions. In some embodiments, the distance is about ⅜ inches. In some embodiments, when the protrusion 136 is positioned at or near the first end 138*a*, the backset dimension can be set at a value of about 2⅜ inches. When the protrusion 136 is positioned at or near the second end 138*b*, the backset dimension can be set at a value of about 2¾ inches. The adjustment of the deadbolt assembly 100 between backset dimensions is described in further detail below.

When adjusting the backset dimension, some components maintain a fixed orientation while other components are rotated about the bolt axis 109. To adjust the backset dimension, a user may grasp the faceplate 106 and/or the bolt 104 and twist. The bolt 104 will rotate about the bolt bar 118, as the bolt connector 124 travels generally helically along the slot 122. Because the bolt 104 and the inner bolt housing 114 are fixed against relative rotation by the rib 114*a* and slot 104*a*, the inner bolt housing 114 rotates with the bolt 104 through a common angle about the bolt axis 109. The common angle may be approximately 180 degrees in the illustrated embodiment. The housing 102 may remain fixed along with the bolt bar 118 and cam 108 during backset adjustment while the protrusion 136 moves along the slot 138. Such an adjustment may be made by rotating the faceplate 106 and/or bolt 104 while the rear end of the assembly (i.e., the housing 102 and the cam 108) is mounted in the door and assembled with additional hardware, which allows user operation of the bolt position. The slots 122 and 138 need not be shaped as a perfect helix, but instead, can be comprised of a combination of curved, straight, and angled portions to achieve an overall axial displacement by rotation of the bolt 104 about the bolt axis 109. Further embodiments are described in greater detail below.

As discussed above, it may be desirable to provide the ends 138*a* and 138*b* of the slot 138 in the housing 102 as limit positions for the protrusion 136. This limits the rotation of the inner bolt housing 114 and the bolt 104 in either direction. To provide tactile and/or audible feedback to the operator adjusting the backset dimension and to assist in maintaining the assembly 100 in one of the two predetermined backset positions, a detent 140 is provided on the upper side of the housing 102. The detent 140 can be located on a deflectable member, which allows a small amount of elastic deflection. In some embodiments, the deflectable member is defined by a groove or a cutout, such as a "U" shaped cutout, which allows the deflectable member to be deflected relative to the housing 102 under a predetermined amount of force. The detent 140 is engageable with one of two holes 142*a* and 142*b*, which are positioned on the inner bolt housing 114 and spaced about 180 degrees from each other. When the protrusion 136 is located adjacent the slot end 138*a* (corresponding to a first, shorter backset dimension), the detent 140 engages the hole 142*a*. When the protrusion 136 is located adjacent the slot end 138*b* (corresponding to a second, longer backset dimension), the detent 140 engages the hole 142*b*. The backset dimensions are discussed further below and illustrated in FIGS. 7-14.

Figure 2:
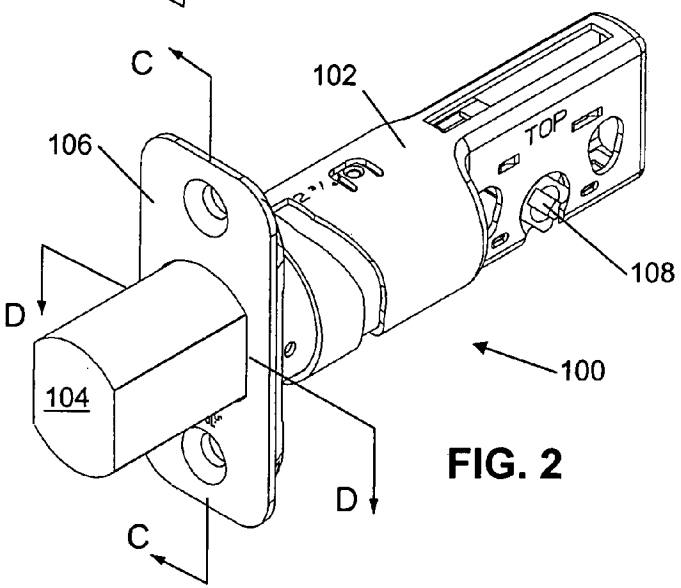
FIG. 2 is a perspective view of a deadbolt assembly with the first backset dimension and the bolt extended according to the first embodiment.
Figure 3:
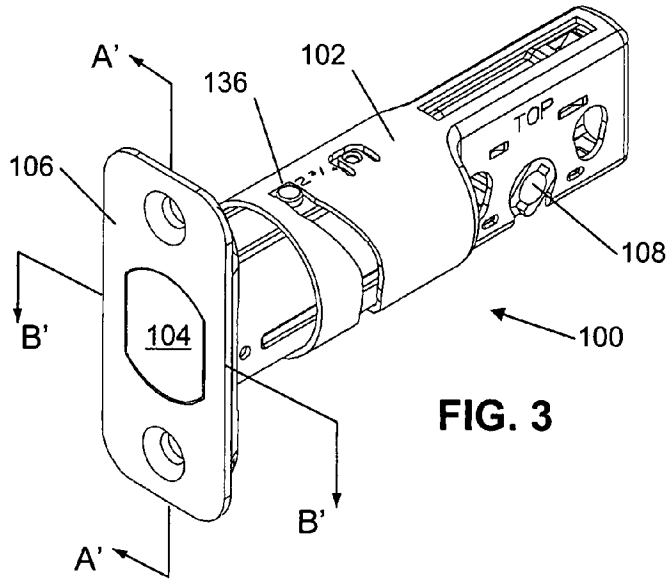
FIG. 3 is a perspective view of a deadbolt assembly with a second backset dimension and the bolt retracted according to the first embodiment.
Figure 4:
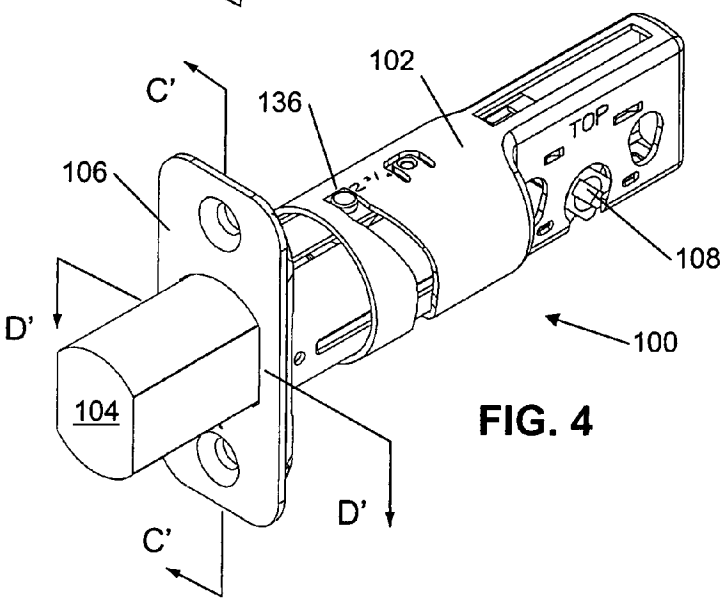
FIG. 4 is a perspective view of a deadbolt assembly with the second backset dimension and the bolt extended according to the first embodiment.
Figure 8:
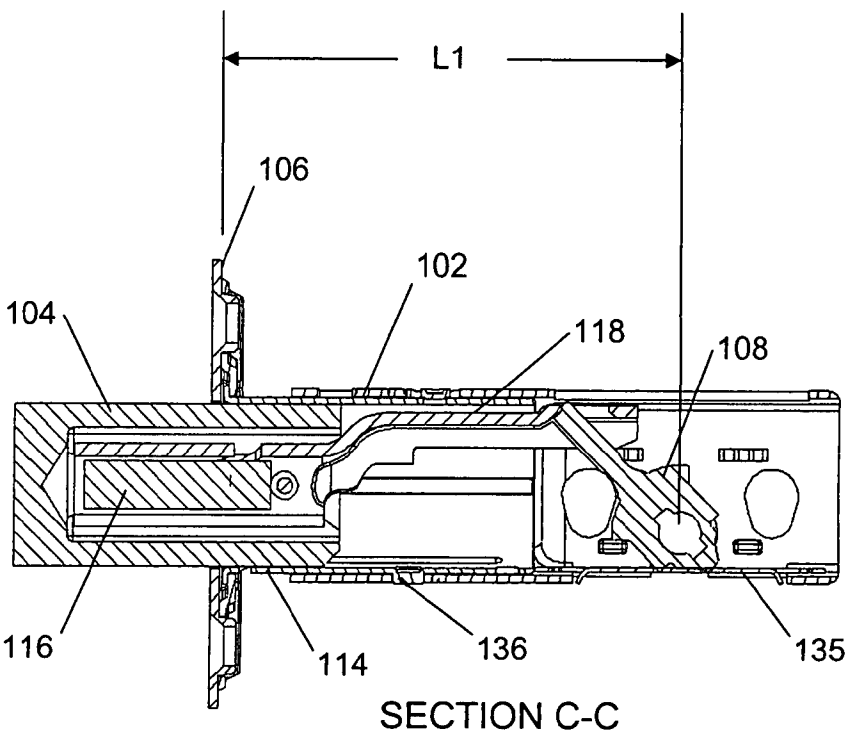
FIG. 8 is a section view taken along line C-C of FIG. 2.
Figure 7:
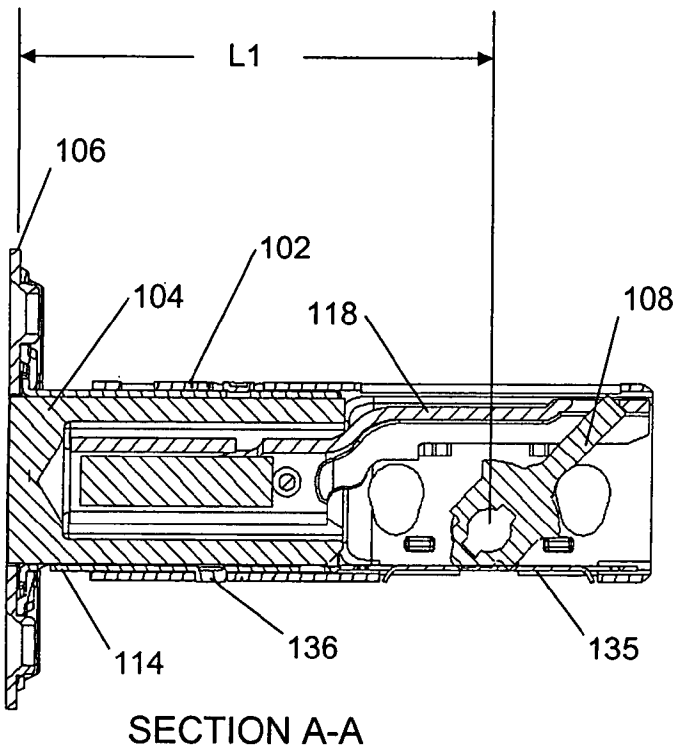
FIG. 7 is a section view taken along line A-A of FIG. 1.
Figure 10:
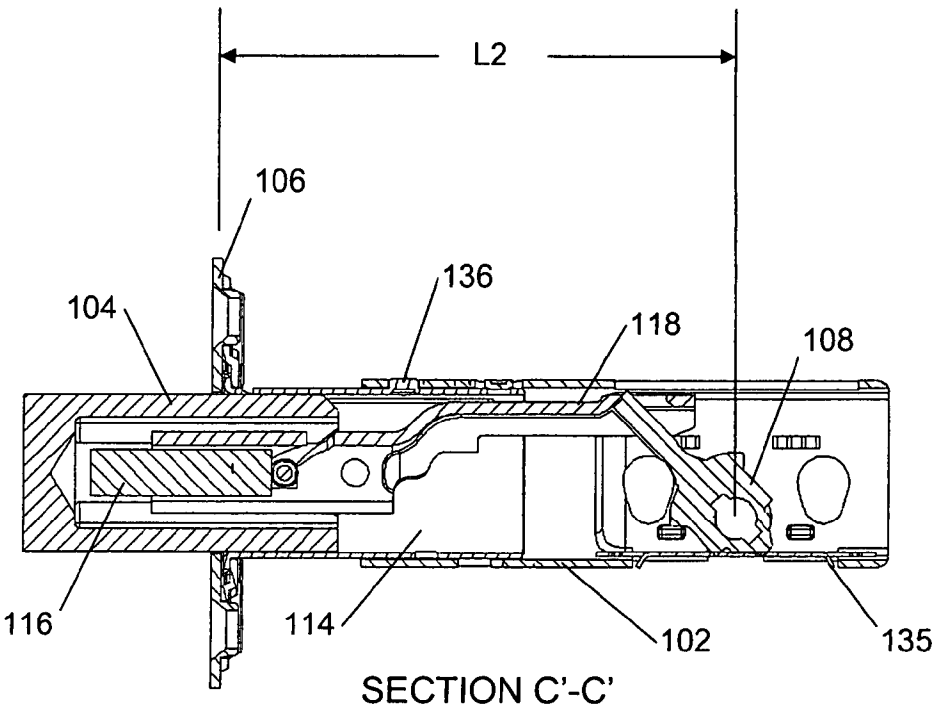
FIG. 10 is a section view taken along line C'-C' of FIG. 4.
Figure 9:
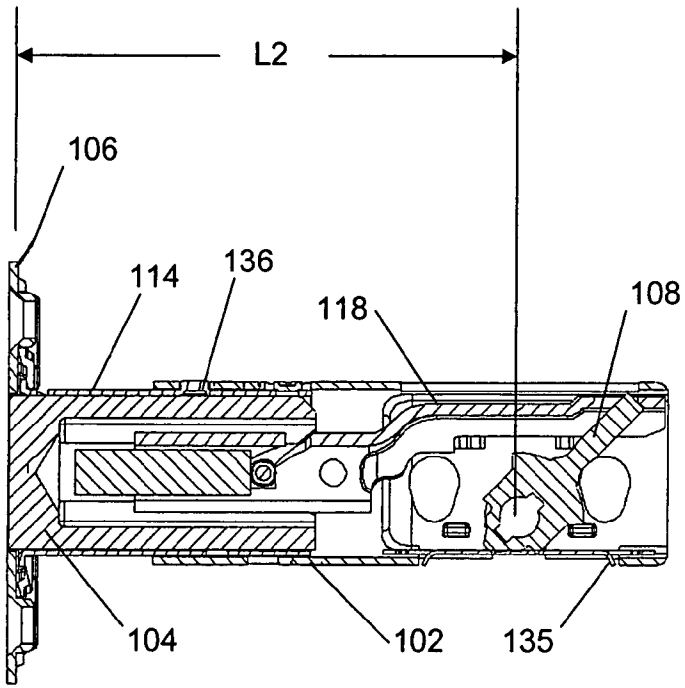
FIG. 9 is a section view taken along line A'-A' of FIG. 3.

Comparing FIG. 1 and FIG. 3 illustrates the difference in backset adjustment while the bolt 104 is in the retracted state. Likewise, FIG. 2 and FIG. 4 illustrate the difference in backset adjustment while the bolt 104 is extended. Several cross-sections are also illustrated to show the arrangement of components within the deadbolt assembly 100 during the various combinations of bolt position and backset dimension. FIG. 7 is a section view taken along line A-A of FIG. 1. FIG. 8 is a section view taken along line C-C of FIG. 2. FIGS. 7 and 8 illustrate the bolt 104 being actuated between the retracted and extended positions, respectively. The backset is equal to the first, shorter backset dimension (referred to hereinafter as L1) in both FIG. 7 and FIG. 8. FIG. 9 is a section view taken along line A'-A' of FIG. 3. FIG. 10 is a section view taken along line C'-C' of FIG. 4. FIGS. 9 and 10 illustrate the bolt 104 being actuated between the retracted and extended positions, respectively. The backset is equal to the second, longer backset dimension (referred to hereinafter as L2) in both FIG. 9 and FIG. 10.

Figure 11:
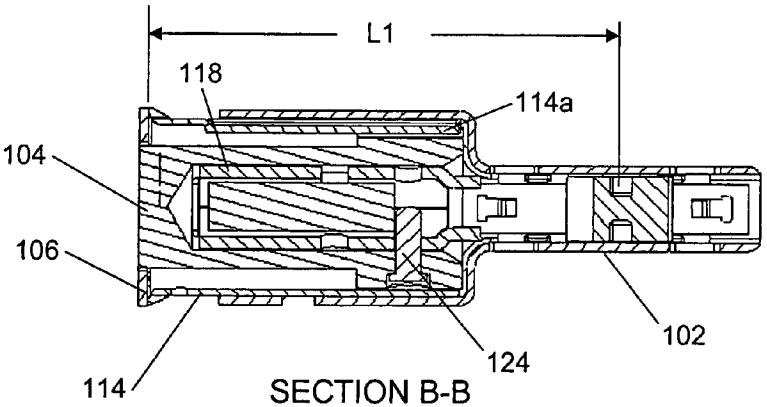
FIG. 11 is a section view taken along line B-B of FIG. 1.
Figure 12:
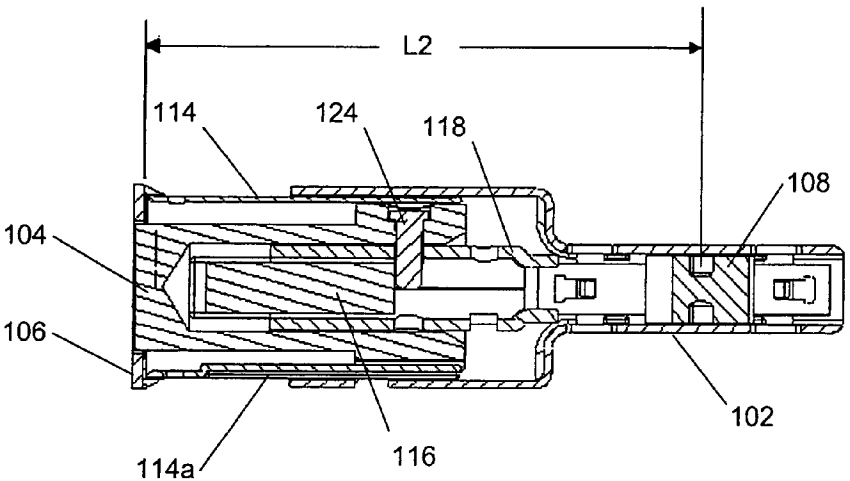
FIG. 12 is a section view taken along line B'-B' of FIG. 3.
Figure 13:
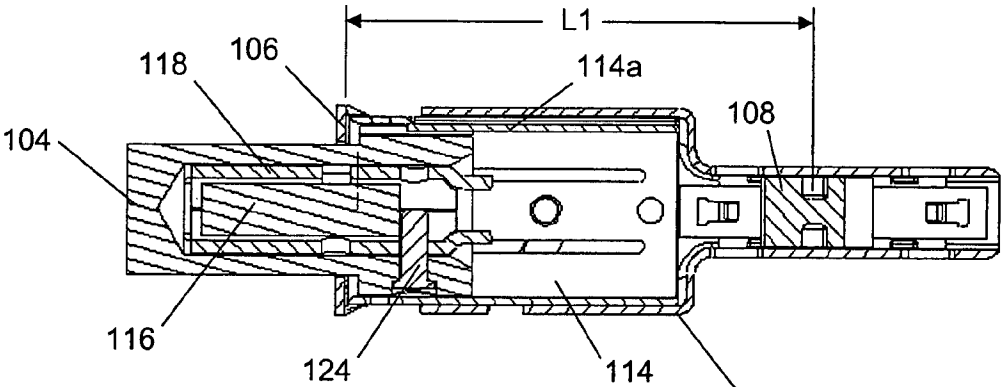
FIG. 13 is a section view taken along line D-D of FIG. 2.
Figure 14:
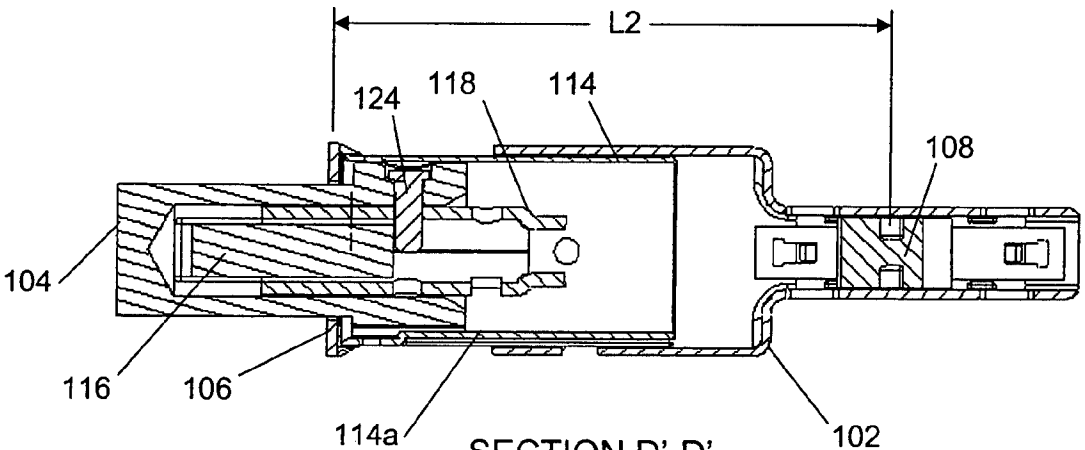
FIG. 14 is a section view taken along line D'-D' of FIG. 4.
Figure 17:
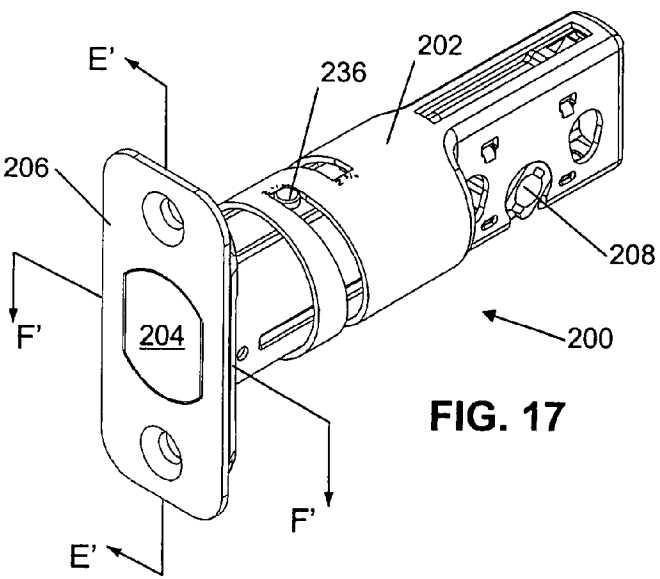
FIG. 17 is a perspective view of a deadbolt assembly with a second backset dimension and the bolt retracted according to the second embodiment.
Figure 18:
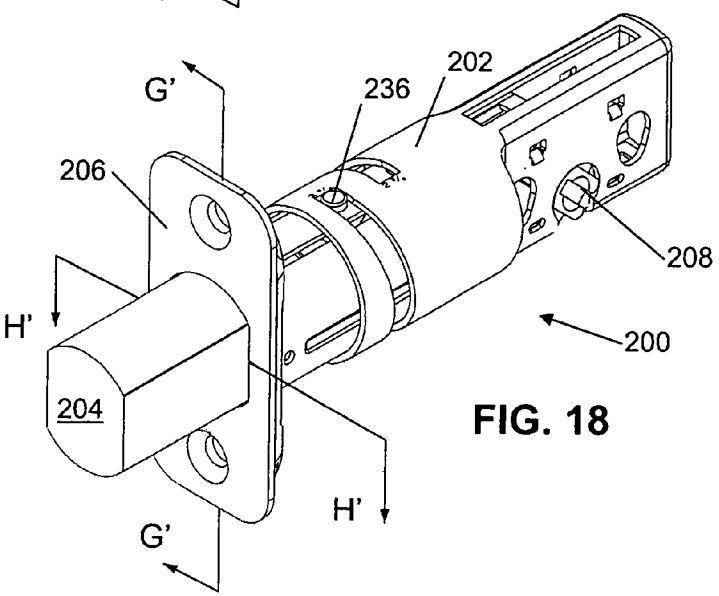
FIG. 18 is a perspective view of a deadbolt assembly with the second backset dimension and the bolt extended according to the second embodiment.
Figure 15:
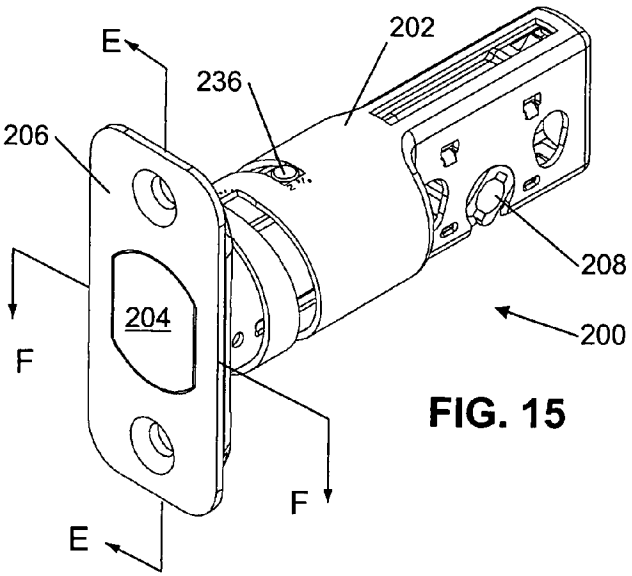
FIG. 15 is a perspective view of a deadbolt assembly with a first backset dimension and the bolt retracted according to a second embodiment.
Figure 16:
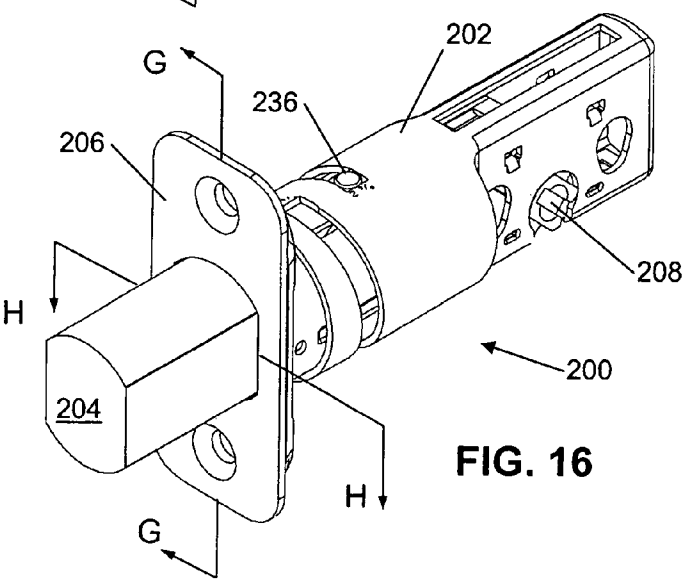
FIG. 16 is a perspective view of a deadbolt assembly with a first backset dimension and the bolt extended according to the second embodiment.

FIG. 11 is a section view taken along line B-B of FIG. 1. FIG. 12 is a section view taken along line B'-B' of FIG. 3. FIGS. 11 and 12 illustrate the deadbolt assembly 100 being adjusted between the L1 backset and the L2 backset, respectively. The bolt 104 is retracted in both FIG. 11 and FIG. 12. FIG. 13 is a section view taken along line D-D of FIG. 2. FIG. 14 is a section view taken along line D'-D' of FIG. 4. FIGS. 13 and 14 illustrate the deadbolt assembly 100 being adjusted between the L1 backset and the L2 backset, respectively. The bolt 104 is extended in both FIG. 13 and FIG. 14.

A deadbolt assembly 200 according to a second embodiment is illustrated in FIGS. 15-28. The deadbolt assembly allows for backset dimension adjustability and is constructed with the same general form as the first embodiment. As such, like reference numbers (in the 200's) are assigned to like parts.

The difference between the first embodiment and the second embodiment is that the deadbolt assembly 200 of the second embodiment allows for adjustment of the backset dimension between predetermined values L1 and L2 by a rotation about the bolt axis 209 of about 360 degrees. As such, the housing 202 is provided with a slot 238, which is generally helical and includes a first end 238*a* and a second end 238*b* that lies substantially adjacent to the first end 238*a*. The first end 238*a* and the second end 238*b* can be positioned on the top portion of the housing 202 and can be spaced apart along an axis parallel to the bolt axis 209 by a distance equivalent to the difference between the two backset dimensions L1 and L2. In some embodiments, the difference between L1 and L2 is about ⅜ inches.

FIGS. 15-18 illustrate the various combinations of bolt position (extended or retracted) and backset adjustment from perspective views. As illustrated, the protrusion 236 of the inner bolt housing 214 is positioned at the top of the assembly 200 in either of the two predetermined backset adjustment positions. Similar to the first embodiment, rotation of the cam 208 actuates the bolt 204 between the extended and retracted positions.

Figure 19:
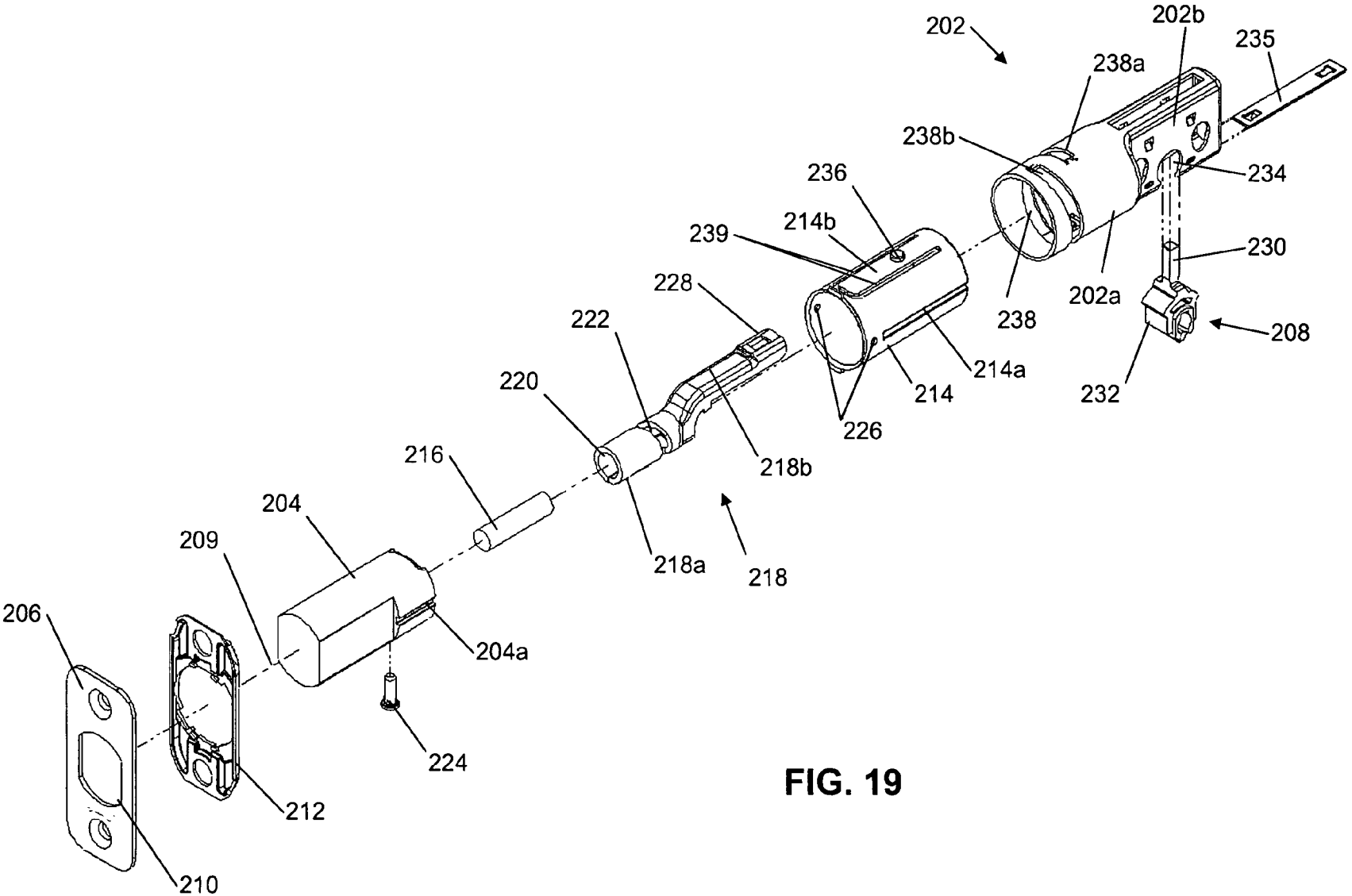
FIG. 19 is an exploded assembly view of the assembly according to the second embodiment.
Figure 20:
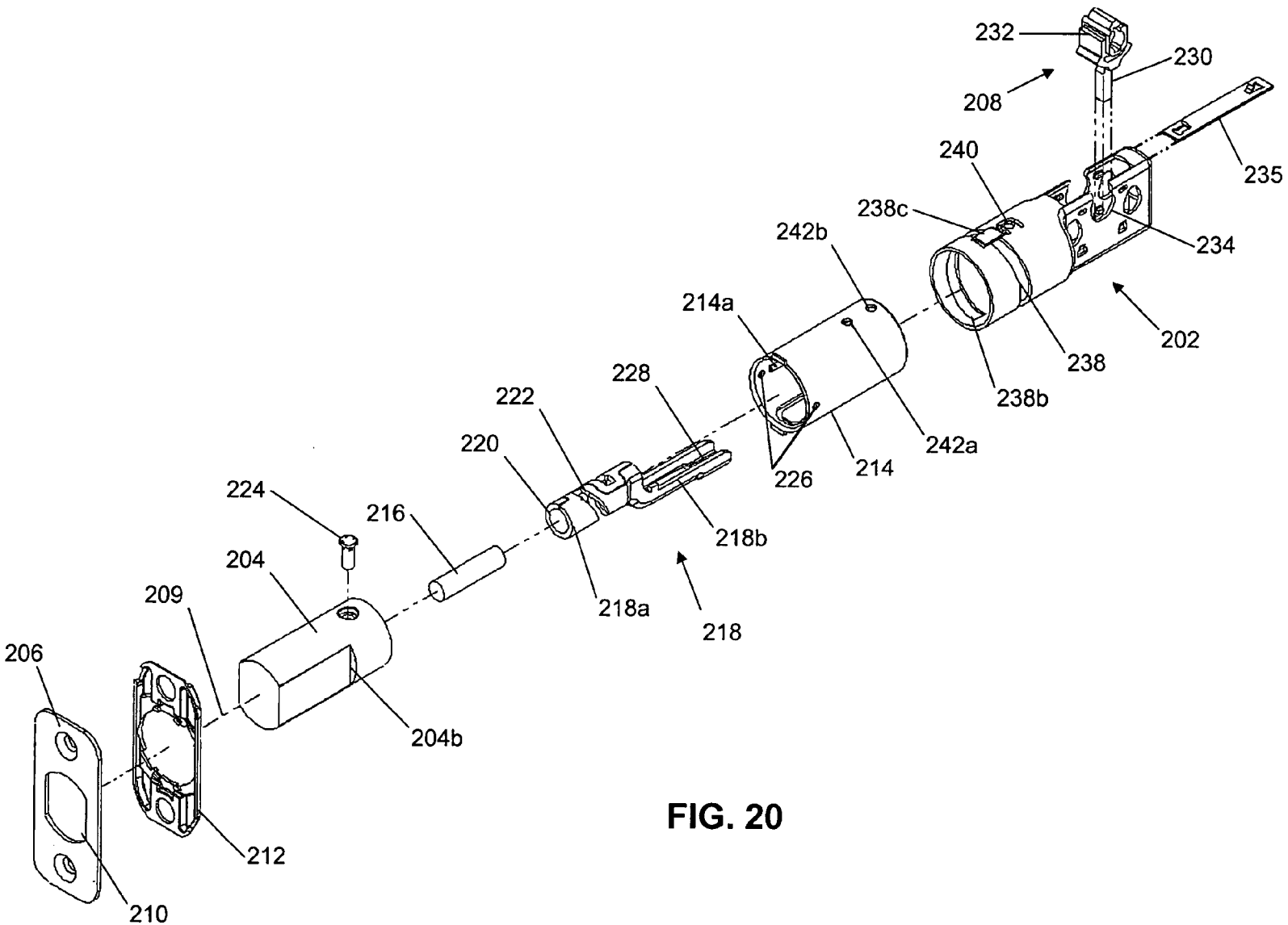
FIG. 20 is a reverse exploded assembly view of the assembly according to the second embodiment.
Figure 22:
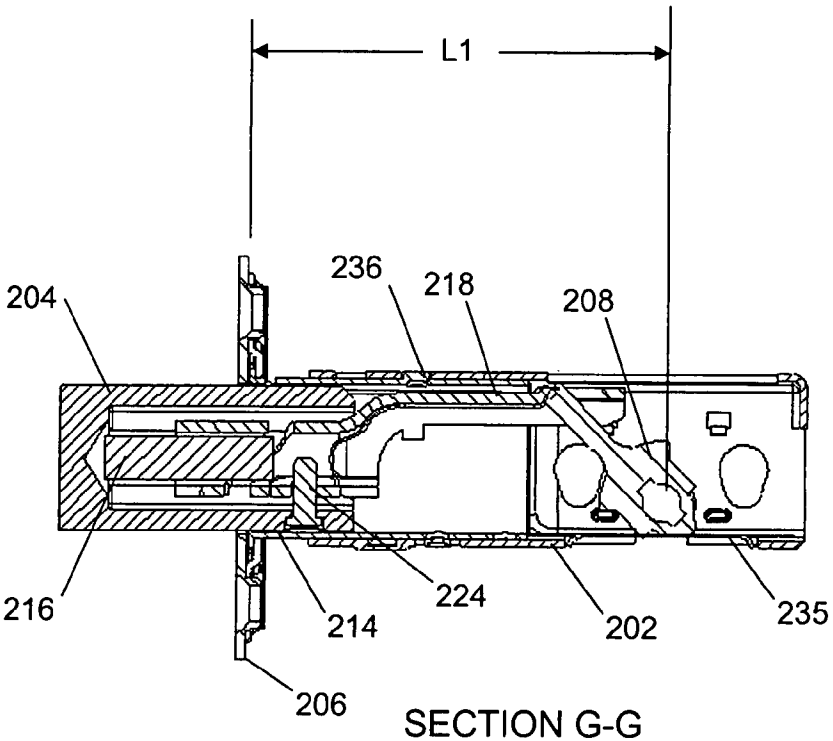
FIG. 22 is a section view taken along line G-G of FIG. 16.
Figure 21:
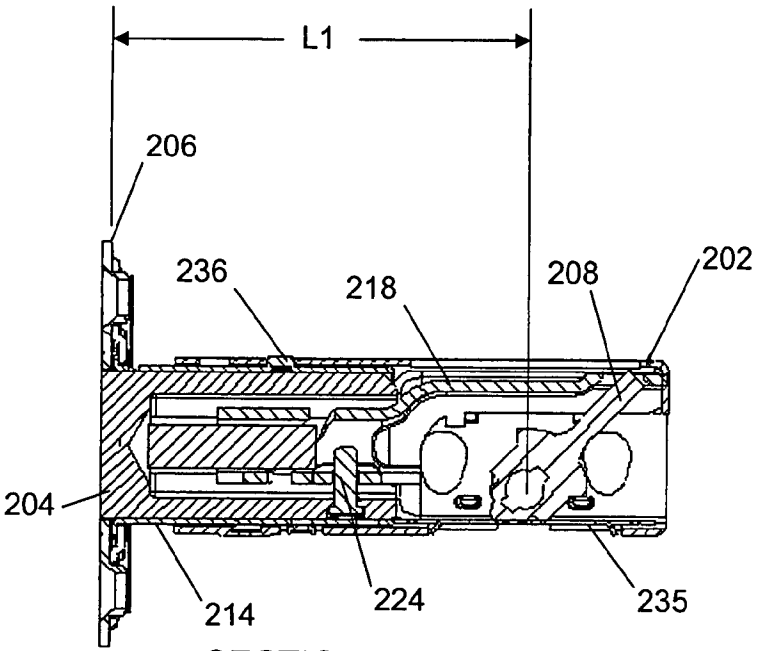
FIG. 21 is a section view taken along line E-E of FIG. 15.
Figure 24:
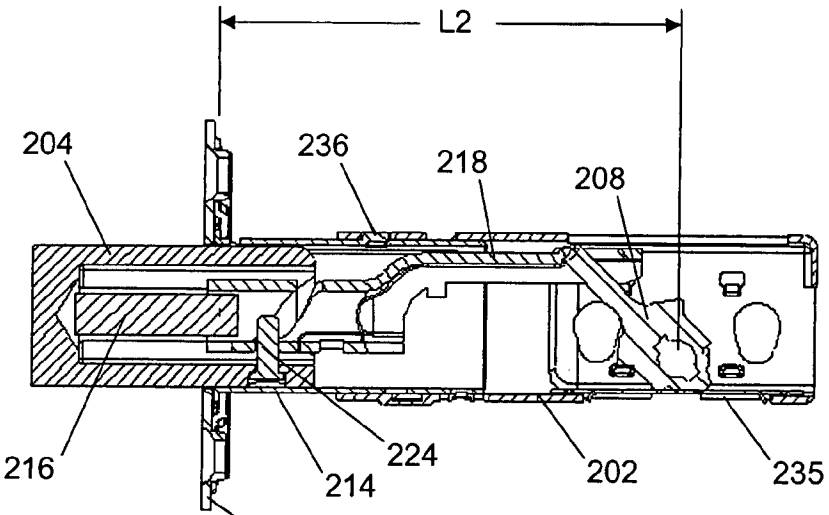
FIG. 24 is a section view taken along line G'-G' of FIG. 18.
Figure 23:
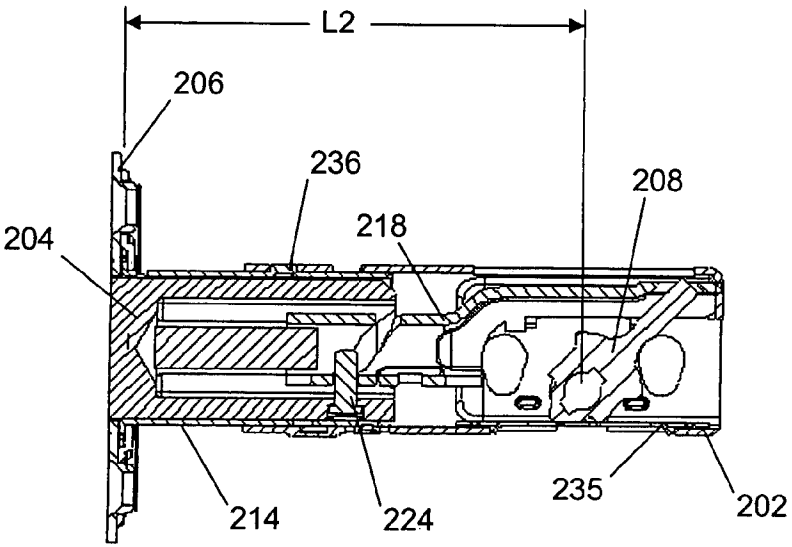
FIG. 23 is a section view taken along line E'-E' of FIG. 17.
Figure 25:
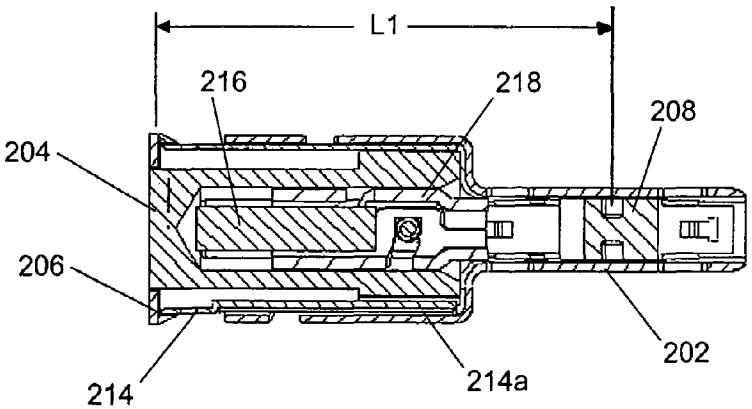
FIG. 25 is a section view taken along line F-F of FIG. 15.
Figure 26:
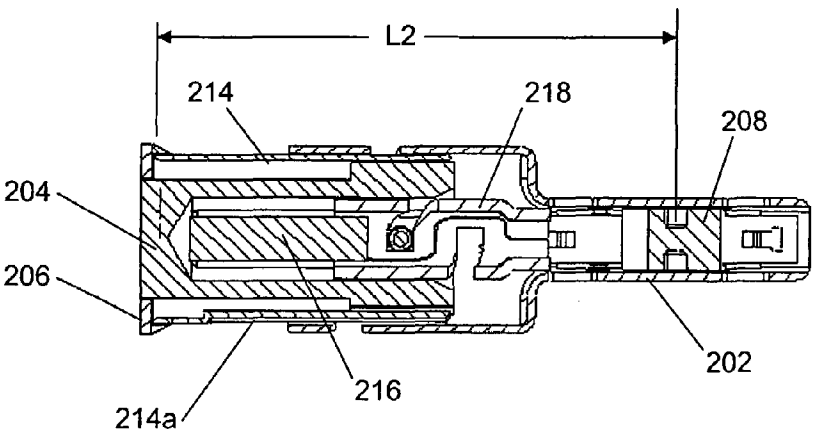
FIG. 26 is a section view taken along line F'-F' of FIG. 17.
Figure 27:
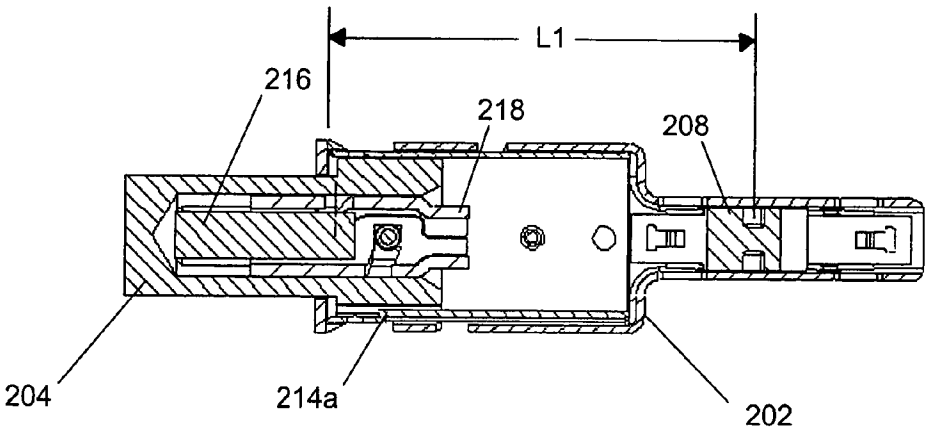
FIG. 27 is a section view taken along line H-H of FIG. 16.
Figure 28:
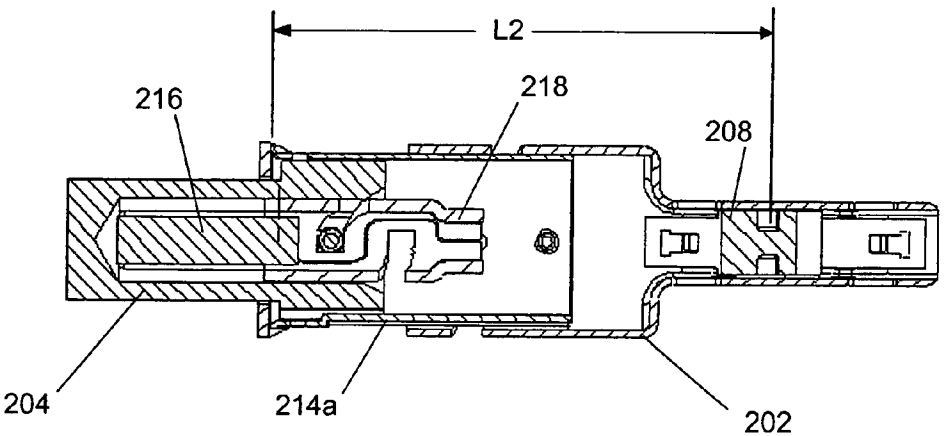
FIG. 28 is a section view taken along line H'-H' of FIG. 18.

FIGS. 19 and 20 illustrate exploded assembly views from two opposing perspectives. The bolt 204 is illustrated with a bolt connector 224, which attaches in the vertical direction. This allows the bolt connector 224 to couple the bolt 204 to the bolt bar 218 via the slot 222 in the bolt bar 218, which is positioned in generally the same orientation and shape as the slot 238 in the housing 202. The bolt connector 224 need not be located in the orientation as illustrated, as long as it is configured to engage properly with the slot 222 in the bolt bar 218, which similarly may be reoriented in alternate embodiments. As noted above, the slots 222 and 238 need not be perfectly helical, but allow an extension or retraction between the housing 202 and the inner bolt housing 214 by relative rotation about the bolt axis 209 to adjust the backset. With reference to FIG. 20, the middle portion of the slot 238 is provided with a reinforcement portion 238*c*, which strengthens the housing 202 at that location. The reinforcement portion 238*c* can be a tab or bridge, which is formed integrally or otherwise coupled to the housing 202 to inhibit deformation of the slot 238 and the housing 202 while allowing the protrusion 236 to pass through from the first end 238*a* to the second end 238*b* and vice versa.

The detent 240 is positioned at the bottom of the housing 202 adjacent the reinforcement portion 238*c*. The first and second holes 242*a* and 242*b* are positioned substantially opposite the protrusion 236 on the inner bolt housing 214 for selective engagement with the detent 240. When the protrusion 236 is positioned adjacent the first end 238*a* of the slot 238, the detent 240 can engage the first hole 242*a* and provide a snapping feature indicating that the assembly 200 is set in the first backset dimension L1. When the protrusion 236 is positioned adjacent the second end 238*b* of the slot 238, the detent 240 can engage the second hole 242*b* and provide a snapping feature indicating that the assembly 200 is set in the second backset dimension L2. The detent 240 and holes 242*a* and 242*b* can also assist in maintaining the assembly in one of the two predetermined backset positions.

With the deadbolt assembly 200 having a 360 degree backset adjustment angle, every component in the assembly 200 maintains a single orientation, whether the backset dimension is set to the first dimension L1 or the second dimension L2. The only positioning that differs when comparing component placement in the L1 backset to the L2 backset is axial shift. The common orientation of parts provides the user with a choice of rotating the front end or the back end to change the backset dimension. For example, the faceplate 206 and bolt 204 can remain fixed in the door while the housing 202 (and along with it the cam 208 and bolt bar 218) is rotated 360 degrees to adjust the backset dimension. This provides an installer with a choice of which end to adjust, should he or she partially install the deadbolt assembly 200 with the incorrect backset dimension. This may save the user time in adjusting the backset.

FIGS. 21-28 illustrate further views of the second embodiment, similar to the views provided of the first embodiment. The figures contain various cross-sectional views, which illustrate the deadbolt assembly 200 in various states. From the figures and the preceding description, the operation of the bolt 204 and the adjustment of the backset dimension are apparent to those of ordinary skill in the art.

Figure 29:
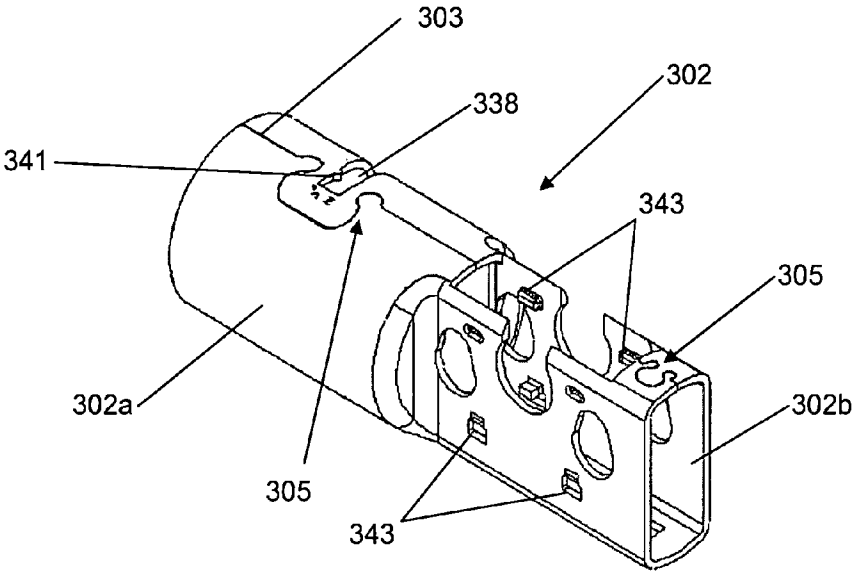
FIG. 29 is a perspective view of a cam/bolt housing of a third embodiment.

As shown in FIGS. 1-28, the housing 102, 202 is provided as a one-piece component, which serves to integrally form a bolt housing and a cam housing. The round front portion 102*a*, 202*a* of the housing 102, 202 houses the bolt 104, 204 and the inner bolt housing 114, 214. The rear rectangular portion 102*b*, 202*b* of the housing 102, 202 houses the cam 108, 208. The bolt bar 118, 218 is movable between the front and rear portions of the housing 102, 202. The housing 102, 202 can be formed as a seamless deep-drawn metal part, but can also take on various other constructions. The housing 102, 202 may be manufactured using a number of processes including, but not limited to, transfer die, progressive die, machining, metal injection molding, and die cast. By forming the housing 102, 202 as a single part that houses the cam 108, 208, the bolt 104, 204, and the bolt bar 118, 218, the assembly component count is reduced as is the assembly time and required effort. Additionally, because there are fewer connections between parts, the structural integrity of the assembly 100, 200 is improved. This eliminates weak points, which often occur at connection locations. In one embodiment, a housing 302 is formed as a rolled, one-piece component as illustrated in FIG. 29. The housing 302 features a longitudinal seam 303, which can be locked with locking fingers 305 in at least one location. The housing 302 is illustrated with a slot 338 of about 180 degrees helically disposed in a front portion 302*a*. At the ends of the slot 338, detents 341 are positioned to engage a protrusion (not shown) that may be on the bolt or inner bolt housing. The detents 341 can keep the protrusion in place and provide tactile and audible feedback to alert the user of proper positioning of the assembly into one of the predetermined backset positions. Piercings 343 are provided in a rear portion 302*b* of the housing 302 to limit the rotation of the cam (not shown) and guide and/or limit the movement of the bolt bar (not shown).

Figure 30:
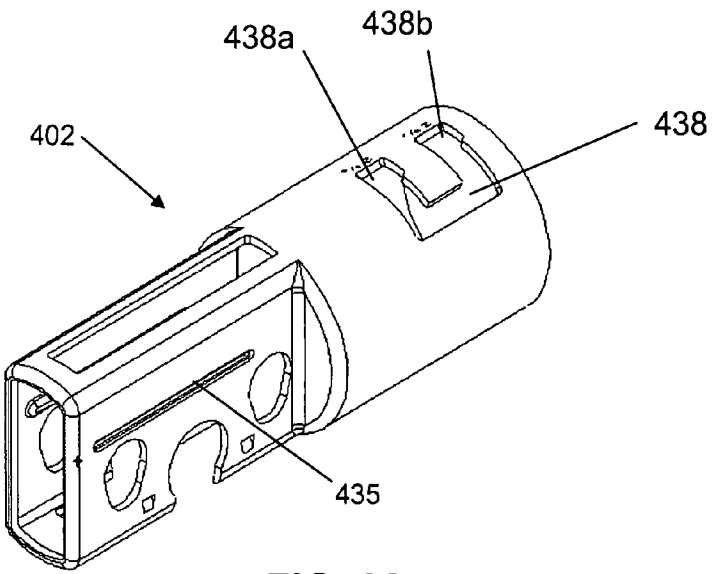
FIG. 30 is a perspective view of a cam/bolt housing of a fourth embodiment.

FIG. 30 illustrates a housing 402 similar in many aspects to the housings 102, 202, and 302 described above with a slot 438 of an alternative configuration. The housing 402 includes a guide rib 435 to guide a bolt bar. In some embodiments, the slot 438 and the slot in the bolt bar are provided as substantially serpentine pathways. In some embodiments, the slots need not be helically disposed at all, but rather, are each shaped as a "U", "V", or "C", providing two ends which define limit positions to set the backset dimension. The housing 402 includes a serpentine "U" slot 438 with a first end 438*a* and a second end 438*b*. Any slot shape that provides at least two positions spaced a distance apart along the bolt axis can be used to define the orientation of components in the predetermined backset dimensions. In some embodiments, this requires a net rotation between parts, such as the helical rotation between the bolt and the housing as described above with reference to other embodiments. In further embodiments, such as the housing 402, a net rotation of zero degrees can be used to adjust the backset dimension. In such an embodiment, the bolt can be rotated relative to the housing 402 through a first positive angle and then slid along the bolt axis (without moving relative to the inner bolt housing or the faceplate) before being rotated a second negative angle, equal in magnitude to the first angle. In further embodiments, it is possible to eliminate the need for any rotation whatsoever by providing telescoping motion between the bolt and the housing separate from the cam-actuated extension and retraction movement.

Thus, the invention provides, among other things, an improved adjustable backset deadbolt assembly. Various features and advantages of the invention are set forth in the following claims.

What is claimed is:

1. An adjustable backset deadbolt assembly comprising:

an outer bolt housing having a helical slot of about 360 degrees;

an inner bolt housing positioned on an interior side of the outer bolt housing and having a protrusion engageable in the helical slot of the outer bolt housing; and a bolt configured for movement along an axis between a retracted position in which the bolt is positioned within the inner bolt housing and an extended position in which the bolt extends from the inner bolt housing, wherein the inner bolt housing and the outer bolt housing are rotatable relative to each other about the axis, guided by movement of the protrusion within the helical slot, to adjust the relative axial positioning between the outer bolt housing and the inner bolt housing and change a backset dimension between a first value and a second value.

2. The adjustable backset deadbolt assembly of claim 1, wherein the bolt is provided with a slot arranged substantially parallel to the axis for engagement with a rib formed on an interior side of the inner bolt housing such that the bolt is inhibited from rotation about the axis relative to the inner bolt housing.

3. The adjustable backset deadbolt assembly of claim 1, wherein the inner bolt housing is provided with a dimple projecting inwardly and positioned to provide a limit to the axial movement of the bolt in at least the extended position.

4. The adjustable backset deadbolt assembly of claim 1, wherein the helical slot is provided with a first end and a second end, and wherein the first and second ends are positioned on the same side of the outer bolt housing and are spaced apart along the axis.

5. The adjustable backset deadbolt assembly of claim 1, wherein the outer bolt housing is provided with a detent configured to provide at least one of audible and tactile feedback confirming positive positioning of the assembly into one of the first and second backset dimension values.

6. The adjustable backset deadbolt assembly of claim 1, further comprising an input cam, a bolt bar, and a pin, the bolt bar being positioned between the input cam and the bolt to transfer rotational movement of the input cam to axial movement of the bolt, wherein the bolt bar includes a generally helical slot of approximately 360 degrees, and wherein the pin is fixedly connected to the bolt and engageable in and movable along the helical slot in the bolt bar when the backset dimension is being changed.

7. The adjustable backset deadbolt assembly of claim 6, wherein when the backset dimension is set to the first value or the second value, the bolt bar is configured to move axially with the bolt between the retracted position and the extended position without relative rotation of the bolt with respect to the bolt bar.

8. The adjustable backset deadbolt assembly of claim 1, wherein the backset dimension is adjustable between the first value and the second value while installed in a door.

9. The adjustable backset deadbolt assembly of claim 1, further comprising a faceplate for attachment to a door in which the deadbolt assembly is installed such that the bolt does not extend beyond the faceplate in the retracted position.

10. The adjustable backset deadbolt assembly of claim 9, wherein the assembly is operable for installation with any one of a square-edged faceplate, a round-edged faceplate, and a drive-in circular latch.

11. An adjustable backset deadbolt assembly comprising:

a bolt movable along an axis between an extended position and a retracted position;

a cam operable to actuate the bolt between the extended position and the retracted position and vice versa; and a first housing rotatable relative to the bolt about the axis, a backset dimension being adjustable between a first predetermined axial value and a second predetermined axial value upon relative rotation between the first housing and the bolt, wherein the relative axial orientation between the first housing and the bolt is variable by an amount substantially equal to the difference between the first predetermined axial value and the second predetermined axial value, and wherein, after adjustment of the backset dimension, the relative rotational orientation between the first housing and the bolt is substantially identical whether the backset dimension is set to the first predetermined axial value or the second predetermined axial value.

12. The adjustable backset deadbolt assembly of claim 11, further comprising a second housing positioned within the first housing, the second housing being keyed to the bolt to inhibit relative rotation therebetween during adjustment of the backset dimension.

13. The adjustable backset deadbolt assembly of claim 12, wherein the second housing is generally cylindrical and includes a longitudinal rib on an inner diameter, which is configured to engage a mating slot in the bolt.

14. The adjustable backset deadbolt assembly of claim 12, wherein the second housing includes a protrusion and the first housing includes a generally helical slot, the protrusion being engageable with the generally helical slot.

15. The adjustable backset deadbolt assembly of claim 14, wherein the generally helical slot includes a reinforcement portion to enhance the rigidity of the first housing.

16. The adjustable backset deadbolt assembly of claim 12, further comprising at least one dimple formed in the second housing to limit the extension of the bolt to the extended position.

17. The adjustable backset deadbolt assembly of claim 12, further comprising a detent formed in the first housing, engageable with one of two recessed portions in the second housing.

18. The adjustable backset deadbolt assembly of claim 17, wherein the two recessed portions are located adjacent one another and one of which is engaged by the detent when the backset dimension is set to one of the first predetermined value and the second predetermined value.

19. The adjustable backset deadbolt assembly of claim 11, further comprising a bolt bar positioned between the cam and the bolt to transfer rotational movement of the cam to an axial movement of the bolt between the extended position and the retracted position, wherein the bolt bar includes a generally helical slot of approximately 360 degrees.

20. The adjustable backset deadbolt assembly of claim 19, further comprising a pin coupled to the bolt, wherein the pin engages the generally helical slot in the bolt bar to transmit axial movement from the bolt bar to the bolt without the pin moving along the generally helical slot in a first condition of the deadbolt assembly, and wherein the pin moves along the generally helical slot in a second condition of the deadbolt assembly to allow rotation of the bolt and the pin relative to the bolt bar during adjustment of the backset dimension.

21. The adjustable backset deadbolt assembly of claim 11, wherein the assembly is compatible with any one of a square-edged faceplate, a round-edged faceplate, and a drive-in circular latch.

22. An adjustable backset deadbolt assembly having a backset dimension adjustable between a first value and a second value comprising:

a bolt configured for movement along an axis between a retracted position and an extended position, the bolt having a slot positioned parallel to the axis;

an outer bolt housing having a helical slot of about 360 degrees, the helical slot having two ends positioned on the same side of the outer bolt housing and spaced apart along the axis;

an inner bolt housing positioned on an interior side of the outer bolt housing, the inner bolt housing including a protrusion on an outer face engageable in the helical slot of the outer bolt housing, a rib on an inner face for engagement with the slot in the bolt, and an inwardly projecting dimple positioned to limit movement of the bolt;

a bolt bar coupling the bolt to an input cam, the bolt being rotatable relative to the bolt bar by movement of a pin fixed to the bolt within a helical slot in the bolt bar to adjust the backset dimension; and a detent feature on the outer bolt housing providing at least one of audible and tactile feedback confirming positive positioning of the assembly into one of the first and second backset dimension values.

* * * * *